United States Patent [19]

Button, deceased et al.

[11] 4,091,931

[45] May 30, 1978

[54] FRUIT SORTING METHOD AND APPARATUS

[75] Inventors: Robert L. Button, deceased, late of Winters, Calif., by Martha Willis Button, executrix; Antone J. Turkovich, Davis, Calif.

[73] Assignee: Robert L. Button, Winters, Calif.

[21] Appl. No.: 614,043

[22] Filed: Sep. 17, 1975

[51] Int. Cl.[2] ..... B07C 5/342

[52] U.S. Cl. ..... 209/73; 209/74 R; 209/75; 209/102; 209/107; 209/111.6; 250/223 R

[58] Field of Search ..... 209/74 R, 74 M, 75, 209/97, 101, 107, 108, 111.6, 102, 106, 74, 73; 250/223 R

[56] References Cited

U.S. PATENT DOCUMENTS

| | | | |
|---|---|---|---|
| 1,427,264 | 8/1922 | Clear | 209/102 |
| 3,034,645 | 5/1962 | Groppe | 209/74 R X |
| 3,435,950 | 4/1969 | Suverkrop | 209/74 R X |
| 3,613,796 | 10/1971 | Cayton et al. | 209/124 X |
| 3,713,537 | 1/1973 | Walker | 209/102 X |
| 3,750,883 | 8/1973 | Irving et al. | 209/111.6 |
| 3,773,172 | 11/1973 | McClure et al. | 209/74 R X |
| 3,781,554 | 12/1973 | Krivoshiev et al. | 209/111.6 X |

*Primary Examiner*—Allen N. Knowles
*Assistant Examiner*—Joseph J. Rolla
*Attorney, Agent, or Firm*—Townsend and Townsend

[57] ABSTRACT

A harvester for collecting fruit such as tomatoes and sorting the tomatoes into acceptable or good tomatoes and culls. The tomatoes including their vines are gathered from the ground and pass rearwardly and upwardly on the harvester to a shaking station where the tomatoes are separated from the vines and other foreign objects. The vines are discharged while the tomatoes are directed to sorting belts disposed laterally of the harvester. The tomatoes are aligned into a plurality of parallel tomato rows of serially arranged tomatoes. The rows are simultaneously moved at a constant speed in a downstream direction past a detection station where each tomato in each row is optically inspected and a reject signal is generated for each cull passing the station. Thereafter, a force is applied to an underside of each cull in response to a reject signal. The force ejects the culls along an inclined trajectory path extending generally upwardly and in a downstream direction from the tomato rows. A cull collector intercepts the ejected culls for discharge while the good tomatoes continue their movement to a collection belt.

8 Claims, 6 Drawing Figures

FRUIT SORTING METHOD AND APPARATUS

BACKGROUND OF THE INVENTION

This invention relates to automatic tomato harvesters which include means other than manual labor for separating from the mass of harvested tomatoes culls, that is, tomatoes having undesirable characteristics such as an off color (e.g. green and unripe), rot, or of an insufficient size.

Tomato harvesting is being increasingly automated. For some time now, tomato harvesting machines or combines are in widespread use. U.S. Pat. Nos. 3,193,020; 3,390,768; and 3,437,151 are illustrative of a tomato harvester that is presently extensively used both domestically and abroad. In summary, this as well as other prior art tomato harvesters sever the tomato vines from the ground and deliver the vines and tomatoes attached thereto to a shaker unit where the tomatoes are separated from the vines. The vines are thereafter discharged to the ground and the separated tomatoes are directed to sorting belts, normally located on each side of the harvester and running longitudinally towards an aft end of the harvester. From the sorting belt the tomatoes are discharged to suitable receptacles carried on trucks driven alongside the harvester through the field.

The lateral sorting belts are relatively long and platforms are positioned so that a multitude of workmen can stand on the platforms and screen the tomatoes passing rearwardly along the sorting belts. The primary task of the workmen is to remove from the belts culls, that is rotted, over-ripe or unripe (green) tomatoes as well as foreign objects such as dirt clods or vines. Because of the large volume of tomatoes carried on the sorting belts it is necessary to accommodate between 20 to 30 workmen on the platforms.

It is apparent that the large number of workmen on the harvester is relatively expensive and significantly contributes to the cost of machine harvesting tomatoes. To reduce these costs attempts have in the past been made to automate the separation of culls from the tomato flow. It is presently estimated that within a relatively short time, perhaps as early as the 1976 harvesting season, tomato harvesters will be available on the market that incorporate an automatic sorting system.

Briefly, the contemplated tomato sorting systems employ optical sensors which inspect each tomato, including culls, and which generate a reject signal in response to the presence of a cull. The reject signal is then used to remove the corresponding cull from the tomato flow towards the collection receptacle. The actual removal of the cull from the tomato flow normally employs free-fall trajectories for all tomatoes in which each cull (in response to a reject signal) is deflected from its trajectory as, for example, by applying an air-blast against the free-falling cull or by mechanically pushing the cull from its free-fall trajectory.

Other prior art automatic sorting systems employ a variety of means for removing culls or unacceptable objects from a flow of tomatoes, fruit or objects such as bottles. These methods push the fruit or object sideways, or upwardly and sideways. Illustrative of such prior art are U.S. Pat. Nos. 3,612,274; 3,770,111; and 3,013,661.

Without questioning the efficacy of the known prior art sorters, they are not well adapted for incorporation in the large number of already existing harvesters which rely on manual sorting. The reasons, therefore, are primarily related to the construction of the sorting systems disclosed in the prior art and specifically to their requirement for substantial additional space either sideways of the sorting belt and/or beneath the sorting belts. A lateral expansion of the harvester, however, is frequently not feasible because they are already built as wide as possible while permitting their movement on highways, railroads, and other transportation means. Space beneath the sorting belts of tomato harvesters is normally severely limited and the necessary space to obtain free-fall trajectories of acceptable length and means for finally discharging the culls to the ground is frequently not available.

SUMMARY OF THE INVENTION

Broadly speaking, the present invention contemplates a new method for sorting a stream of objects such as a stream of tomatoes by separating from the stream objects having predetermined characteristics. The method comprises the steps of arranging the object stream into at least one row of objects in which the objects are serially arranged and moving them in a downstream direction to a detection station. At the detection station each object is screened to determine if it has the predetermined characteristic and if it does a reject signal is generated at the detection station. Downstream of the detection station the rejected object is removed from the object row by subjecting such object to an upwardly directed impulse which has a force component parallel to the direction of object movement and which has a sufficient magnitude so that the rejected objects are removed from the object row along an initially upwardly inclined and downstream directed trajectory. The thus ejected object is thereafter intercepted for collection and suitable discharge.

In the preferred embodiment of the invention the above summarized method is incorporated into a tomato harvester in which the objects comprise tomatoes and tomato culls. As the harvester moves through a tomato field it gathers tomato growing vines and carries them upwardly and rearwardly to a vine shaker to separate the tomatoes from the vines. Thereafter the tomatoes are collected at a first location on a sorting belt and divided into a plurality of parallel, linear, side by side tomato rows, each of which comprises a multitude of serially arranged tomatoes.

The tomatoes in each row are supported from lateral sides and moved rearwardly past a detection station. An open gap is maintained beneath each row which extends longitudinally from about the first location towards the detection station so that undersized tomatoes having a transverse dimension less than a width of the gap can drop therethrough. The undersized tomatoes are then discharged to the ground.

At the detection station, each tomato in each row is independently optically inspected. Each time a cull or a foreign object is detected a reject signal is generated and fed to an ejector provided for each tomato row and positioned downstream of the detection station. The ejector may be an air-blast nozzle or a pneumatically actuated plunger and is aligned with the gap beneath the corresponding row and oriented to exert a force to an underside of the culls and foreign objects to propel them along the above-mentioned upwardly inclined trajectory. The ejected culls and foreign objects are then collected by a transverse conveyor and moved perpendicular to the normal travel direction of the harvester for discharge to the ground.

The good or acceptable tomatoes continue their downstream movement. They are substantially continuously supported, particularly immediately downstream of the ejection point, until they are discharged for subsequent processing.

The sorting system of the present invention has substantial advantages over prior art sorting systems. The culls are ejected along an upwardly inclined trajectory and intercepted at a point vertically above the ejection point or at least above the tomato flow downstream of the ejection point. Consequently, the cull collection does not require space lateral of or below sorting belts of existing harvesters. Instead, the culls are collected above the sorting belts where existing harvesters have sufficient space to mount a transverse conveyor. Consequently, the present invention is ideally suited for retrofitting existing tomato harvesters so that they can be operated in a highly automated and efficient manner by eliminating the need for a large number of expensive workmen.

Furthermore, the sorting system of the present invention does not require that the good tomatoes be dropped along a free-fall trajectory. Instead, the good tomatoes continue their downstream movement while substantially fully supported at all times. Accordingly, they do not accumulate a relatively high kinetic energy (as they would during a free-fall) which can bruise or rupture tomatoes upon impact on receiving surfaces such as a conveyor belt.

Thus, the present invention substantially improves the quality of the end product, namely, the harvested and sorted, ripe tomatoes and assures that the tomatoes, though machine harvester and sorted, be as close as possible to their natural, undamaged state. This is accomplished with equipment which is readily and relatively inexpensively incorporated on existing tomato harvesters using manual sorting.

DESCRIPTION OF THE PREFERRED EMBODIMENTS

Figures 1, 2:
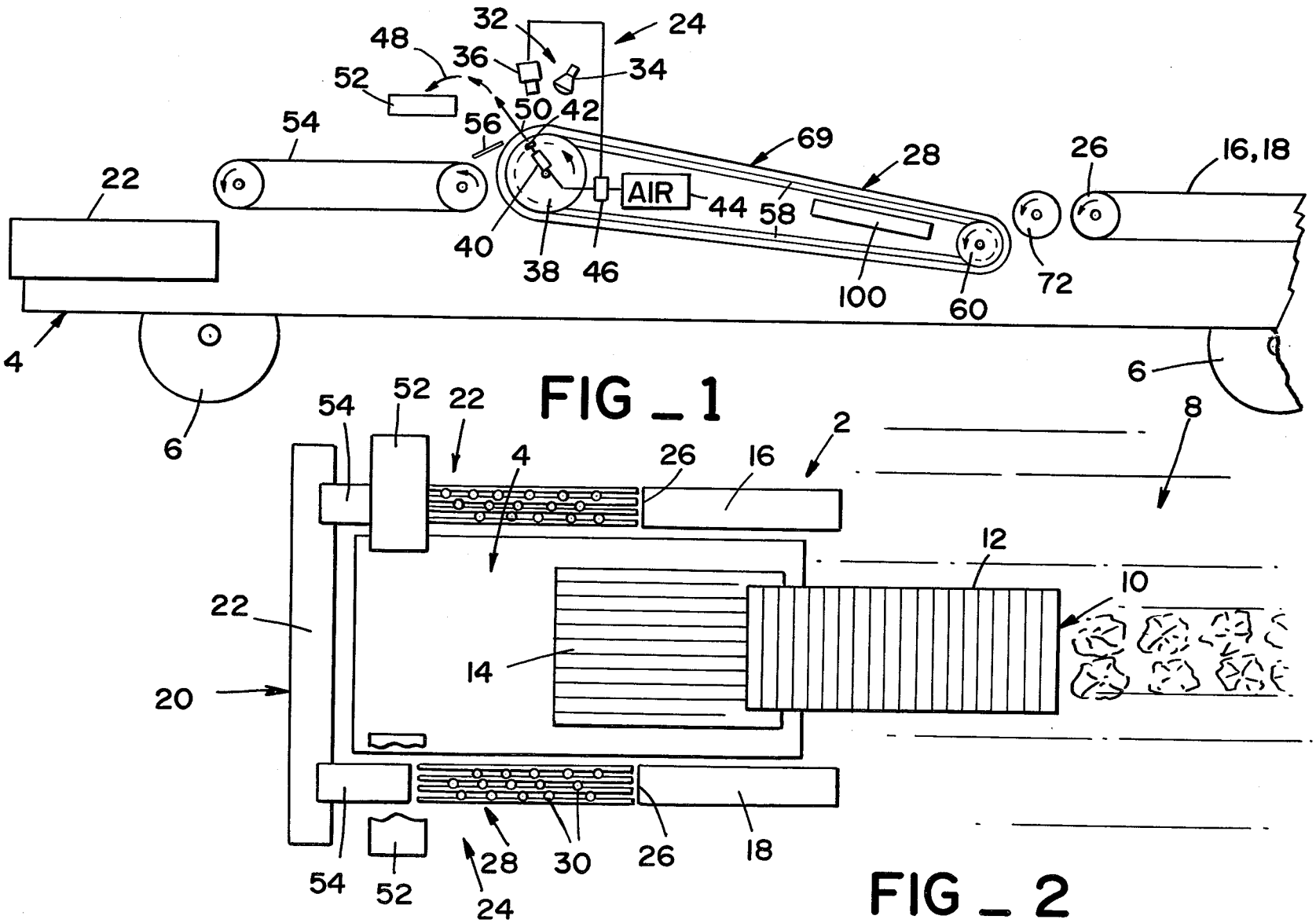
FIG. 1 is a schematic side elevational view illustrating a tomato harvester fitted with a tomato sorting device constructed in accordance with the present invention.
FIG. 2 is a schematic plan view of the harvester illustrated in FIG. 1.
Figure 3:
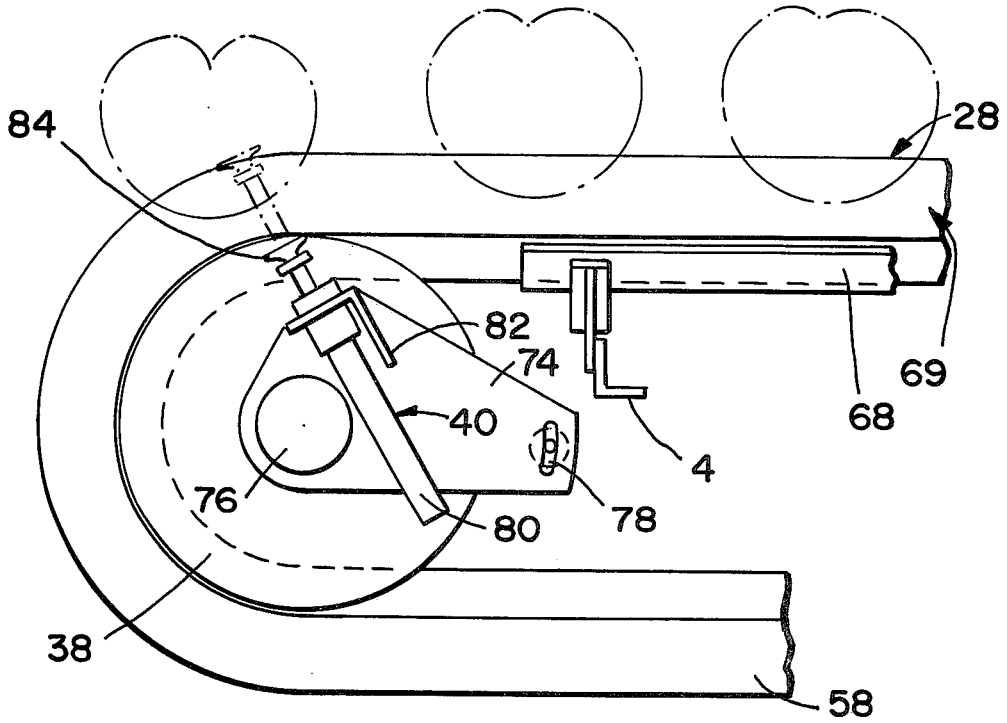
FIG. 3 is an enlarged, fragmentary side elevational view of the cull ejection mechanism of the present invention.
Figure 4:
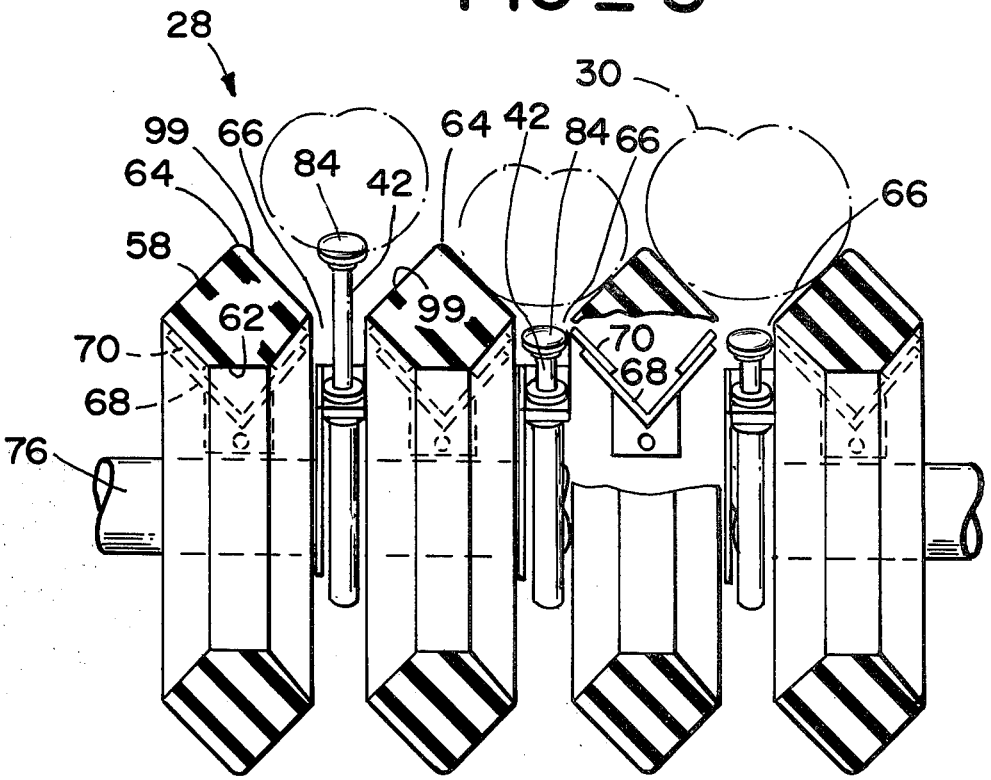
FIG. 4 is a front elevational view in section, and is taken on line 3—3 of FIG. 4.
Figure 5:
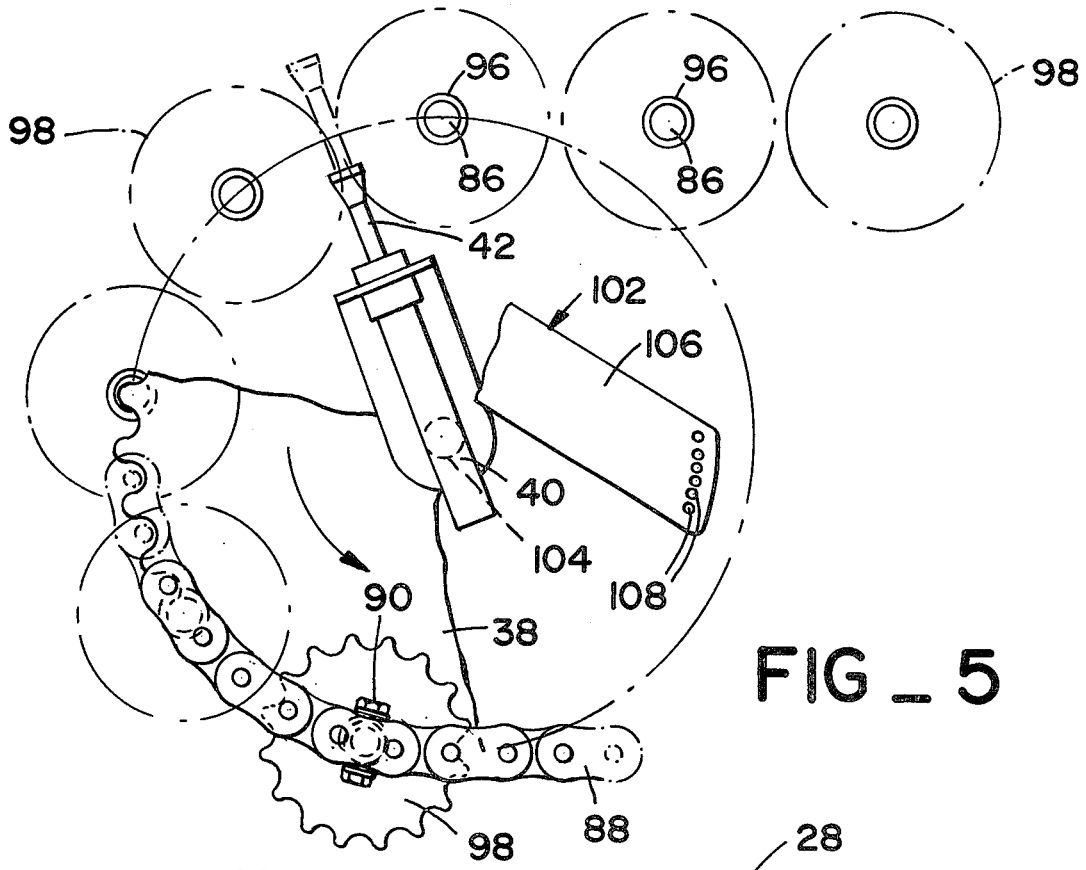
FIG. 5 is a fragmentary side elevational view, similar to FIG. 3, but illustrates another embodiment of the invention.
Figure 6:
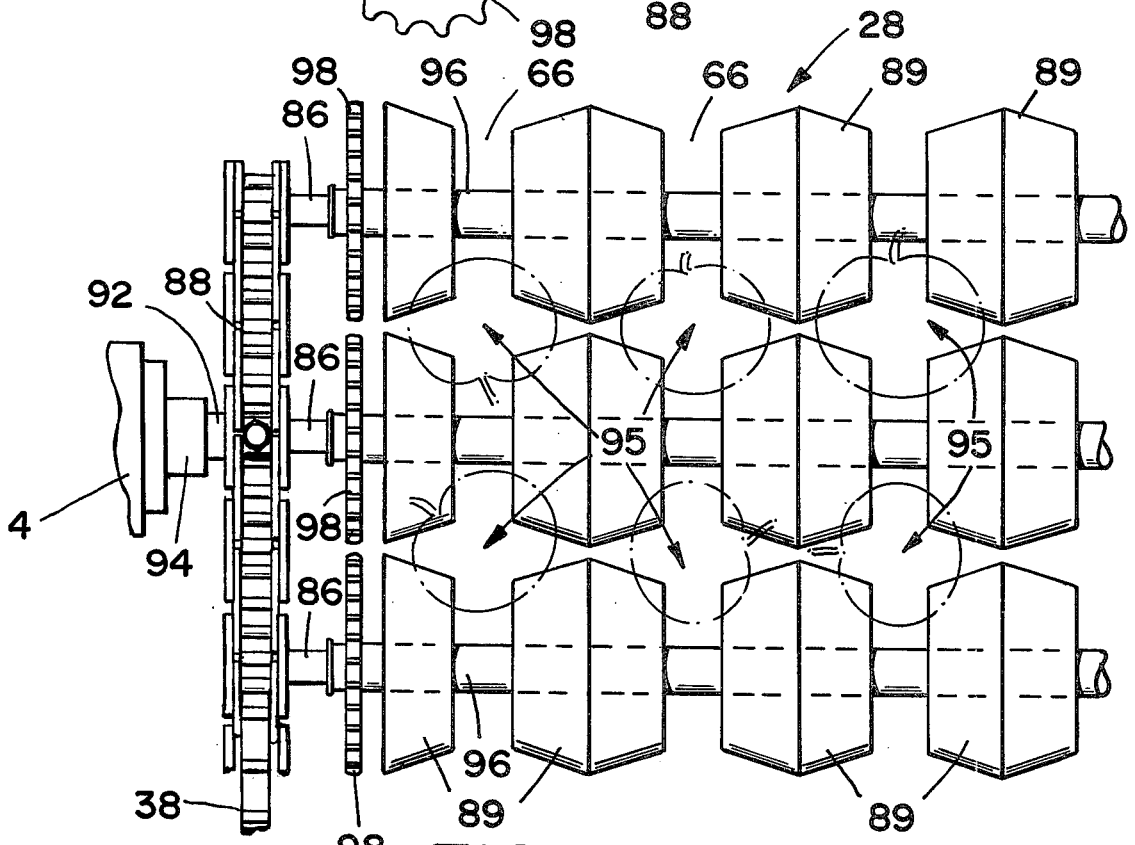
FIG. 6 is a fragmentary plan view of the embodiment shown in FIG. 5.

Referring first to FIGS. 1 and 2, a mobile tomato harvester 2 generally comprises a frame 4 supported by a plurality of power driven and steerable wheels 6 which move the harvester over a tomato field 8, for example. Adjacent a forward end of the harvester is an elevator 12 the forward end of which is closely adjacent the tomato field. The elevator receives tomato vines and tomatoes and carries them upwardly and rearwardly to a vine shaker 14. The shaker is of a conventional construction and separates the tomatoes from their vines. The vines are discharged to the ground while the separated tomatoes are collected beneath the shaker and moved laterally of the harvester to a pair of rearwardly running, laterally spaced tomato conveying side belts 16 and 18.

Adjacent an aft end 20 is a transverse tomato collection belt 22 on which all tomatoes of acceptable quality are deposited for movement transversely to the harvester movement through the field and for discharge of such tomatoes into a suitable receptacle which is drawn alongside the harvester by a truck or the like. In the past, the side belts 16, 18 extended over substantially the full length of the frame to the transverse collection belt. A workers' platform (not shown) was provided alongside each side belt where workers manually sorted the tomato flow on the side belts and removed therefrom culls, (e.g. green tomatoes) as well as foreign objects such as vines, rocks, dirt clods and the like. In accordance with the present invention the side belts are relatively short and their primary function is to collect tomatoes separated from their vines by shaker 14. A tomato sorting system 24 constructed in accordance with the present invention is interposed between aft ends 26 of the side belts 16, 18 and the collection belt 22.

The sorting system 24 generally comprises a pair of tomato aligning conveyors 28 which receive tomatoes from side belts 16, 18 and which arrange the tomatoes into a plurality of side by side tomato rows 30 of serially arranged tomatoes. Each conveyor transports the tomatoes from the aft end 26 of the corresponding belts 16, 18 in a rearward and slightly inclined but generally horizontal direction past an optical detection station 32. The detection station is defined by a light source 34 and a light and color-sensitive photo electric cell 36 capable of generating an output or reject signal when a cull, e.g. a tomato with an off-color such as green passes the inspection station. A photo cell 36 is provided for each tomato row on conveyor 28 so that each tomato in each row is inspected by a photo cell.

As will be more fully described hereinafter, conveyor 28 is constructed so that it has a longitudinally extending gap between each tomato row. Undersized tomatoes as well as small foreign objects can drop through the gap for discharge to thereby help in the sorting process of good tomatoes from culls and foreign objects. The conveyor is looped around an end pulley 38 and in the space defined by the end loop of the conveyor are a cull ejecting device 40 for each tomato row on the conveyor. The ejecting device preferably comprises a pneumatically actuated plunger 42 which is positioned so that it extends in a generally upwardly inclined and rearwardly oriented direction. The plunger is aligned with the corresponding gap in the conveyor and it is connected with a source of pressurized air 44 via a solenoid valve 46. The solenoid valve is electrically coupled with photo cell 36 and opens the valve in response to the detection of a cull so that pressurized air extends plunger 42 upwardly and rearwardly to contact the underside of the cull and eject it from the tomato row on the conveyor along an upwardly and rearwardly inclined trajectory indicated by line 48 in FIG. 1. A conventional time delay is incorporated in the circuit connecting photo cell 36 and valve 46 so that the plunger is actuated when the cull detected by the photo cell reaches the ejection point 50 on conveyor 28.

An elevated cull conveyor 52 is positioned so that the conveyor intercepts the cull trajectory 48. The cull conveyor moves the culls transversely to the harvester and its movement through the field to a point lateral of the harvester for discharge of the culls to the ground or to a suitable receptacle (not shown).

Good tomatoes, that is, tomatoes having the desired color characteristics continue their rearward travel on conveyor 28. Following ejection point 50 the travel path is directed downwardly along the downward curvature of the conveyor loop. A final inspection belt 54 is positioned to receive good tomatoes discharged by the sorting belt 28 and transports them to transverse tomato collection belt 22 at the aft end 20 of the harvester. To avoid tomatoes discharged by the sorting belt from dropping vertically a bridge plate 56 is preferably provided which receives the good tomatoes from the end loop of conveyor 28 and rollingly directs such tomatoes onto the final inspection belt. Bruising and possible tomato damage from excessive free-fall distances are thereby avoided; instead, the tomatoes continue their rearward travel through and past the inspection station and the ejection point while substantially continuously supported.

The trajectory along which the culls are ejected from the tomato rows on sorting belt 28 is selected according to the available space for placement of the cull conveyor 52. Thus, particular applications, especially when the sorting system is added to an existing tomato harvester, may require different ejection angles to reach the cull conveyor with ejected culls. It is important, however, that the general direction of the trajectory is rearwardly and upwardly inclined. In this manner, the kinetic energy of the cull being transported rearwardly by sorting belt 28 is utilized in ejecting the cull and reaching the cull conveyor. This means that for a given distance a lesser force is necessary (which results in a lesser likelihood of rupturing the ejected cull) or that with a given force a greater distance can be covered. At the same time it is not necessary to transport the good tomatoes a substantial distance in a downward direction to provide clearance for the ejection of the culls and the cull conveyor. Consequently, the good tomatoes are not subjected to significant free-fall energies which can cause damage to them.

Turning now to the detailed construction of the sorting system 24 of the present invention and referring to FIGS. 1 through 4, in a first embodiment, aligning conveyor 28 is defined by a plurality of parallel, side by side belts 58 constructed of a resilient material such as rubber or plastic and looped over aft end pulley 38 and a forward pulley 60. The belts have a generally square configuration, a vertical diagonal and a truncated lower end defining a flat base surface 62. The upper edge 64 of the belt is preferably rounded to avoid sharp edges that can come in contact with tomatoes and the belts are spaced apart to define a gap 66 therebetween. The gap extends over the full length of the conveyor, as well as around the end pulleys and its width is selected so that tomatoes of an unacceptably small size deposited on the belt drop through the gap for discharge to the ground. In a typical embodiment, the gap has a width of approximately $\frac{3}{4}$ inch so that tomatoes of a diameter less than about $\frac{3}{4}$ inch are discharged. Elongate belt support brackets 68 may be provided to support the upper belt strands 69 carrying tomato rows 30. Low friction pads 70 in contact with belts 58 may be secured to the brackets or the support brackets may be replaced with intermittently mounted support rollers (not shown in the drawing) to minimize belt wear.

A suitable motor such as a hydraulic motor (not shown) is provided to drive the belts and therewith move tomato rows 30 from side belts 16, 18 to and past the detection station 32. A cleaning disc roller 72 may be interposed between the end of the side belts and the beginning of aligning conveyor 28 to help remove vines, leaves and the like which might be present on the side belts. The construction of such cleaning discs is conventional and well-known and therefore not further described herein.

The cull ejecting device 40 is preferably mounted to a gusset plate 74 which is journaled about a shaft 76 for end pulleys 38 and which can be angularly adjusted with a set screw protruding through a slot 78 in the gusset plate. The ejecting device is a pneumatic actuator having a cylinder 80 mounted to the gusset plate via a bracket 82 and the plunger or piston 42. The plunger has an end face 84 which contacts the underside of a cull to be ejected and which applies the actual ejection force so that the cull travels via the trajectory 48 to cull conveyor 52. The end face may be slightly curved to minimize unit pressure applied to the cull and therewith to minimize the likelihood of skin rupture when the cull is ejected.

It will be noted that the precise orientation of the reciprocating plunger movement can be adjusted by pivoting gusset 74 about shaft 76 within the confines of gusset slot 78. The precise trajectory path can therewith be adjusted to attain optimal conditions and a precise landing of the ejected culls on cull conveyor 52.

Referring now to FIGS. 1, 2, 5 and 6, in another embodiment of the invention, aligning conveyor 28 is constructed of a multiplicity of spaced apart rollers 89 which align the tomatoes in rows and transport the rows from side belts 16, 18 to and past detection station 32. The conveyor illustrated in FIGS. 5 and 6 comprises a multiplicity of transverse bars 86, the ends of which are secured to a pair of laterally spaced apart endless roller chains 88 with belts 90. The roller chain is looped over a disc sprocket which defines end pulley 38. A similar disc sprocket defines the forward pulley 60 for the roller chain of conveyor 28. The disc sprockets are journaled on an axle 92 secured to frame 4 via a suitable mounting bracket 94. The axles may be cantilevered or extend over the full width of the conveyor.

Transverse bars 86 are secured to and extend between the roller chains at regular intervals. Each bar is fitted with a plurality of double tapered rollers and a single tapered roller, having the configuration of a truncated cone, adjacent each end of the bar. Opposing faces of the rollers are spaced apart to define between them the above mentioned gap 66 through which undersized tomatoes may drop for discharge to the ground or for other suitable disposal.

In use side belts 16, 18 deposit tomatoes on sorting conveyor 28 and the tomatoes will align themselves in tomato rows 30 by positioning themselves in pockets 95 defined by every four proximate corners of each set of four adjacent rollers 89. Thus, the tomatoes form an aligned grit of tomatoes, the precise relative position of which is at all times known because the tomatoes will collect at specified points over the length of the conveyor and their linear spacing is therefore constant. As is more fully discussed hereinafter, this facilitates the ease with which culls can be ejected after they are detected by the photo cell 36.

To facilitate the positioning of a tomato in each pocket 95 of the conveyor, the rollers 89 are preferably rotated adjacent the forward end of the conveyor where side belts 16, 18 deposit tomatoes in a random fashion across the full width of the conveyor. For this purpose, it is preferred to mount rollers 89 on a tube 96 which is rotatable about transverse bars 86. A sprocket 98 is secured to each tube adjacent one end thereof and means such as a stationary and a driven or power driven roller chain 100 may be positioned beneath conveyor 28 so that the teeth of sprocket 98 engage such a chain. The forward movement of the sprocket relative to the chain causes a corresponding rotation of the sprockets 98, tubes 96 and rollers 89 mounted thereto. This rotation of the conical roller surfaces facilitates the positioning of tomatoes in the pockets. If desired, the rate of rotation as well as the direction of rotation can be altered by driving the chain 100 in one or the other direction at variable speeds.

Normally, this rotating movement of the rollers is not necessary over the remainder of the length of the conveyor. However, in instances where full inspection of substantially the complete surface of each tomato is required, roller rotation may again be induced in the vicinity of the inspection station so that the tomato being inspected moves not only longitudinally past the detection station but rotates with respect thereto about a horizontal axis whereby substantially the full tomato surface is presented to photo cell 36. This is particularly useful for detecting culls having partially rotted surfaces since such partially rotted surfaces might otherwise remain hidden from the photo cell.

Ejectors 40 may be mounted as described above and shown in FIG. 3. Alternatively, the ejectors may be mounted to a generally U-shaped bracket 102 which is pivotable about a stub shaft 104 concentric with disc axle 92. The other leg 106 of the U-shaped bracket includes a slot or a plurality of bores 108 for anchoring the bracket with a suitable bolt (not shown) or the like to adjust the relative angular orientation of the ejectors and to thereby adjust the trajectory of ejected culls. The U-shaped bracket spans the full width of sorting conveyor 28 and mounts an ejector for each tomato row 20 transported past the detection station.

The operation of the harvester of the present invention in general and the sorting mechanism in particular should now be apparent. To briefly summarize it and referring to all the drawings, the harvester is driven through field 8 parallel to rows of tomato plants. Vines are severed, transported to shaker 14 and the separated tomatoes are discharged onto side belts 16 and 18. The side belts transport the tomatoes rearwardly onto aligning conveyor 28. The intermediate cleaning disc 72 removes leaves, branches or vines which may have reached the side belts and the aligning conveyor thereafter orients the tomatoes into spaced apart longitudinal tomato rows which are moved rearwardly towards detection station 32. Any undersized tomatoes as well as small foreign objects drop through gaps 66 between belts 58 (or rollers 89) for discharge to the ground while the larger tomatoes are supported by the two opposing, downwardly sloping belt surfaces 99. Each tomato in each row is optically inspected for color correctness by the photo cell 36. If the tomato is of an acceptable quality, conveyor 28 continues to transport the tomato rearwardly. As the belt (or roller) loops downwardly over end pulley 38, the tomatoes of each row roll over bridge plate 56 onto the final inspection belt 54 for the subsequent discharge onto collection conveyor 22.

When photo cell 36 detects a cull it generates a reject signal which, after the appropriate time delay, is applied to solenoid valve 46 to actuate plunger 42 and eject the cull along trajectory 48. The transverse cull conveyor 52 receives the ejected cull and discharges it over the side of the harvester to the ground. The embodiment of the invention illustrated in FIGS. 5 and 6 has the advantage that it facilitates the ease with which the culls are ejected because the tomatoes in each row are equally spaced by the equally spaced pockets 95.

It will now be apparent that the present invention eliminates some of the shortcomings encountered with prior art automatic tomato sorters. In particular, the bulk of the tomatoes, that is the good tomatoes are transported from the short side belts 16, 18 to the transverse collection belt 22 at the aft end of the machine in a substantially horizontal manner. The good tomatoes at no time have to drop over extended free-fall trajectories to effect the removal of culls. Consequently, possible damage to the good tomatoes as well as a substantial vertical space to allow for the free-fall drop of the tomatoes is unnecessary. The sorting system 24 of the present invention can therefore be installed on existing harvesters which do not have such vertical clearance. Only the transverse cull conveyor 52 is positioned outside the generally horizontal extent of the tomato conveyor. However, it is positioned above the tomato conveyor where additional space is readily available. By ejecting the culls along a downstream or rearward and upwardly inclined trajectory, only a relatively small amount of additional kinetic energy must be transferred to the culls.

I claim:

1. A tomato harvester comprising:

a frame movable over a tomato field;

means for gathering tomato vines and tomatoes from the field and for transporting them onto the harvester;

means on the harvester for separating the tomatoes and the vines;

means for discharging the vines from the harvester;

means for directing the separated tomatoes to a first location on the harvester;

aligning conveyor means mounted to the frame for receiving tomatoes at the first location, aligning the tomatoes into a plurality of side by side parallel rows of serially arranged tomatoes and for transporting the tomato rows in a downstream direction from the first location;

the conveyor being defined by a plurality of side by side, spaced apart elements defining opposing, tomato supporting surfaces and a gap therebetween, the gap extending over the full length of the conveyor, a detection station including a photo cell for each tomato row for inspecting each tomato in such row and for generating a reject signal in response to the presence of a cull at the detection station;

a cull ejector for each row positioned beneath the corresponding row and in alignment with the corresponding gap at a second location, the ejector including a power-driven plunger extensible through the gap into contact with a cull detected at the detection station and means for reciprocating the plunger between its extended and its retracted position in which the plunger does not contact culls or tomatoes carried past it by the aligning conveyor;

means operatively coupled with the cell and the reciprocating means for actuating the retracting means in response to a reject signal when the corresponding cull passes the plunger;

means orienting the plunger so that it reciprocates in a downstream and upwardly inclined direction for the ejection of the culls along an upwardly inclined, downstream oriented trajectory;

transport means positioned downstream of the plunger for transporting good tomatoes to a collection point, the transport means including means for substantially continuously supporting the good tomatoes during their transport between the second location and the collection point; and a cull conveyor mounted to the frame generally downstream of the second location at a vertical elevation above the transport means and in the ejected cull trajectory for receiving ejected culls and discharging them.

2. Apparatus according to claim 1 wherein the spaced apart elements of the aligning conveyor means comprise spaced apart, endless belts including downwardly inclined, opposing surfaces terminating at the gap for supporting the tomatoes.

3. Apparatus according to claim 1 wherein the spaced apart elements of the aligning conveyor comprises a multiplicity of roller pairs serially arranged over the length of the conveyor; each roller pair being defined by two rollers having the shape of a truncated cone; minor diameters of the truncated cones being proximate each other and spaced apart to define the gap; whereby tomatoes are positioned at constant intervals in depressed pockets defined by four adjacent rollers.

4. Apparatus according to claim 3 including means for intermittently rotating the rollers about their axes.

5. A tomato harvesting method for the infield collection of tomatoes and their separation into acceptable tomatoes for subsequent processing and culls for subsequent discharge including the steps of gathering the tomatoes including their vines; separating the tomatoes from vines and other foreign objects; directing the separated tomatoes to a sorting station, separating the culls from the tomatoes at the sorting station, and discharging the culls to the ground, the improvement comprising the steps of: aligning the tomatoes into a plurality of parallel rows, each row comprising serially arranged acceptable tomatoes and culls; simultaneously moving all rows at a constant speed in a downstream direction past a detection station; optically inspecting each tomato in the rows and generating a reject signal for each cull passing the detection station; ejecting each cull passing the detection station in response to a reject signal along an inclined trajectory path extending generally upwardly and in a downstream direction from the tomato rows by positioning at the detection station a piston having an aft end and a generally flat face for contacting the underside of the culls; orienting the piston so that the face reciprocates in alignment with the beginning of the trajectory path, and applying compressed air to the aft end in response to a reject signal to thereby propel the face into contact with the cull and eject the cull; moving the acceptable tomatoes in a downstream direction to a tomato collecting station for the subsequent processing of such tomatoes, collecting the culls at a location vertically above the acceptable tomatoes; and discharging the collected culls.

6. A harvester for collecting fruit and sorting such fruit into acceptable fruit and off-color culls comprising in combination means for arranging the collected fruit into a plurality of side by side, parallel rows of fruit, the fruit in each row being serially arranged; means for moving the fruit in each row at a constant speed past a detection station, the fruit moving means including means providing access to the to the fruit from beneath; optical detection means at the station for each row, including a photo-sensor generating a reject signal for each cull passing the station; an ejector for each row positioned beneath the row and downstream of the detection station and comprising means extensible through the access providing means for applying a force to an underside of each cull passing the ejector, means operatively coupled with the photo-sensor for activating the ejector when a cull passes the ejector, the ejector being positioned so that the force applying means propels the cull in an upward and downstream direction along an inclined trajectory; means for gathering acceptable fruit downstream of the ejector for subsequent use of such fruit; and means positioned in the trajectory path for collecting the culls and keeping them separate of the acceptable fruit.

7. A method for harvesting vine grown tomatoes comprising the steps of:

moving a harvester through a tomato field and gathering tomato growing vines;

carrying the gathered vine upwardly and rearwardly on the harvester to a vine shaker;

shaking the vines to separate therefrom substantially all tomatoes;

collecting the separated tomatoes at a first location;

dividing the tomatoes into a plurality of parallel, linear, side by side tomato rows, each row comprising a multitude of serially arranged tomatoes;

supporting the tomatoes in each row from lateral sides and moving the supported rows rearwardly past a detection station while maintaining an open gap beneath each row which extends longitudinally from about the first location towards the detection station so that undersized tomatoes having a transverse dimension less than a width of the gap can drop therethrough;

discharging undersized tomatoes which have dropped through the gap to the ground;

at the detection station independently optically inspecting each tomato in each row and determining culls and foreign objects in the row which are to be rejected and generating a reject signal in response to the detection of each cull or foreign object passing the detection station;

positioning a force applying device for each tomato row downstream of the detection station and in alignment with the gap beneath the corresponding row, the device being oriented to exert a force to an underside of culls and foreign objects in response to each reject signal when such cull or foreign object passes a second location downstream of the detection station, the device being further oriented so that the force propels such cull or foreign object along an inclined trajectory path upwardly of and in a downstream direction from the second location;

collecting ejected culls and foreign objects at a point above the acceptable tomatoes and downstream of the second location;

moving collected culls and foreign objects transversely to the downstream direction and discharging the culls and foreign objects to the ground;

moving acceptable tomatoes in a downstream direction and substantially continuously supporting the acceptable tomatoes until they reach a third location downstream of the second location; and collecting the acceptable tomatoes at the third location and discharging them from the harvester for subsequent processing of such tomatoes without the need for further sorting operations.

8. A harvester for collecting tomatoes and sorting such tomatoes into acceptable and off-color culls comprising in combination a frame movable over a tomato field; conveyor means for arranging the collected tomatoes into at least one row of serially arranged tomatoes and for transporting the row in a rearward direction past a detection station; a photo cell at the detection station for inspecting each tomato in the row and for generating a reject signal for each cull; cull ejecting means including an extensible plunger positioned beneath the aligning conveyor downstream of the detection station, the plunger being reciprocable in an upwardly inclined and rearwardly oriented direction; the aligning conveyor including an opening through which the plunger can extend into contact with a cull; means for extending the plunger in response to a reject signal when the cull is at an ejection point; whereby the plunger propels the cull along an inclined trajectory away from the aligning conveyor; means for substantially continuously supporting non-rejected, good tomatoes after they have passed the ejection point and for transporting the good tomatoes to a collection point; and cull collecting means mounted to the frame at a point above the good tomato supporting and transporting means and in the trajectory of the ejected culls for receiving such culls.

* * * * *